US005746328A

United States Patent [19]

Beeler et al.

[11] Patent Number: 5,746,328

[45] Date of Patent: May 5, 1998

[54] PEGBOARD-MOUNTABLE ADJUSTABLE MERCHANDISING RACK

[75] Inventors: Mark T. Beeler; Brian H. Welker, both of Winston-Salem, N.C.

[73] Assignee: Decision Point Marketing, Inc., Winston-Salem, N.C.

[21] Appl. No.: 702,260

[22] Filed: Aug. 23, 1996

[51] Int. Cl.[6] ..... A47F 7/00

[52] U.S. Cl. ..... 211/59.3; 248/220.41

[58] Field of Search ..... 211/87, 880.01, 211/59.3, 59.1, 193; 248/220.41, 224.51, 223.41, 223.42

[56] References Cited

U.S. PATENT DOCUMENTS

| | | | |
|---|---|---|---|
| 2,730,825 | 1/1956 | Wilds | 40/10 |
| 2,954,129 | 9/1960 | Gordon | 211/49 |
| 3,110,402 | 11/1963 | Mogulescu | 211/49 |
| 3,308,961 | 3/1967 | Chesley | 211/49 |
| 3,357,597 | 12/1967 | Groff | 211/279 |
| 3,780,873 | 12/1973 | Silva | 211/49 |
| 3,848,745 | 11/1974 | Smith | 211/49 |
| 4,269,326 | 5/1981 | Delbrouck | 211/227 |
| 4,351,439 | 9/1982 | Taylor | 211/49 |
| 4,479,583 | 10/1984 | Franklin et al. | 211/49 |
| 4,540,222 | 9/1985 | Burrell | 312/257 |
| 4,705,175 | 11/1987 | Howard et al. | 211/59 |
| 4,723,663 | 2/1988 | Learn | 211/59 |
| 4,729,481 | 3/1988 | Hawkinson et al. | 211/59.3 |
| 4,730,741 | 3/1988 | Jackle, III et al. | 211/59.3 |
| 4,732,282 | 3/1988 | Lockwod | 211/59.2 |
| 4,733,782 | 3/1988 | Spezial et al. | 211/57.1 |
| 4,762,235 | 8/1988 | Howard et al. | 211/59.3 |
| 4,762,236 | 8/1988 | Jackle, III et al. | 211/59.3 |
| 4,785,943 | 11/1988 | Deffner et al. | 211/59.2 |
| 4,798,013 | 1/1989 | Sanato | 40/651 |
| 4,813,535 | 3/1989 | Radocha et al. | 248/220.41 |
| 4,830,201 | 5/1989 | Breslow | 211/184 |
| 4,898,282 | 2/1990 | Hawkinson et al. | 211/49.1 |
| 4,907,707 | 3/1990 | Crum | 211/59.3 |
| 4,923,070 | 5/1990 | Jackle et al. | 211/59.2 |
| 5,012,936 | 5/1991 | Crum | 211/59.3 |
| 5,027,957 | 7/1991 | Skalski | 211/59.3 |
| 5,088,607 | 2/1992 | Risafi et al. | 211/59.3 |
| 5,109,992 | 5/1992 | Miller | 211/59.1 |
| 5,131,563 | 7/1992 | Yablans | 221/92 |
| 5,318,187 | 6/1994 | Rosenthal | 211/88 |
| 5,351,839 | 10/1994 | Beeler et al. | 211/59.3 |
| 5,353,939 | 10/1994 | Beeler et al. | 211/59.3 |

*Primary Examiner*—Peter M. Cuomo
*Assistant Examiner*—Gerald A. Anderson
*Attorney, Agent, or Firm*—Rhodes Coats & Bennett, L.L.P.

[57] ABSTRACT

An apparatus for displaying products at retail on a pegboard having spaced holes includes at least two pegboard connection elements each including a wedge-shaped back plate, upper and lower inward-facing grooves spaced apart a first distance and prongs spaced apart by a distance equal to spacing between holes in the pegboard. Knife brackets have upper and lower outwardly-facing flanges engageable with a corresponding pegboard connection by lateral insertion of the flanges in the grooves to engage the knife brackets with the pegboard connection elements and a plurality of indentations along a direction extending from the pegboard. A tray supported on the knife brackets has a catch shaped to be received in one of the indentations to permit the spacing of the tray from the pegboard to be adjusted to a desired distance. The tray includes front and rear walls having downward-facing ledge elements with one of the ledge elements being resiliently mounted to its respective wall. A product pusher having forward and rearward facing protrusions is held in place by locating the protrusions under the ledges. The pegboard connection elements may be mounted on the pegboard by insertion of their respective prongs through holes in the pegboard, the knife brackets may each be engaged with a corresponding connection element to extend from the pegboard, and the tray may be mounted on the knife brackets.

12 Claims, 3 Drawing Sheets

PEGBOARD-MOUNTABLE ADJUSTABLE MERCHANDISING RACK

BACKGROUND OF THE INVENTION

The present invention relates to an improved adjustable display rack, particularly suited for mounting on pegboard.

The inventors previously disclosed adjustable point-of-purchase displays in U.S. Pat. No. 5,351,839 entitled Vertically Adjustable Pusher Point-of-Purchase Display and U.S. Pat. No. 5,353,939 entitled Variable Pusher Point-of-Purchase Display. The disclosures of those two patents are incorporated here in by reference. Those patents relate to display racks for use in a merchandising environment for making an attractive presentation of a product by presenting a product close to the consumer using pushers adjustably mounted in a tray. Those patents specifically disclose mounting the tray on vertical standards. The present invention goes a step further and provides a mounting for a display on pegboard, which is commonly used in the fabrication of retail store fixtures.

While it is known to provide supports for retail display shelves on pegboard, a problem with the versatility of such displays is not addressed by the prior art, to the knowledge of the inventors.

More particularly, while pegboard is provided with a plurality of holes arranged in a regular, evenly spaced array, adjacent sheets of pegboard are not mounted so that the holes in the pegboard of the adjacent sheets match up to continue the regularity of the array from one sheet to the other. Thus, a support for a rack or tray that provides for prongs or protrusions based upon the regularity of the holes in the pegboard cannot be used to span across two adjacent sheets of pegboard. This greatly inhibits the versatility of the mounting of the tray.

Another problem with the spanning of sheets of pegboard arises from the fact that the pegboard is mounted in vertical standards which protrude forwardly from the plane of the pegboard. Thus, a rack or support that fits tight against the pegboard is blocked from being positioned adjacent to such a standard.

Also, when a plurality of levels of racks are to be mounted on the pegboard, spacing problems are encountered. If a tray is to be mounted lower than an existing tray, the necessary movement to install the prongs in the pegboard is inhibited. The portion of the rack which is to extend laterally from the pegboard must be directed upwardly so the prongs of the pegboard mount can enter the holes in the pegboard, followed by the pivoting downward of the supports to a lateral position. If a tray or other item is already in position above the intended location, there is not sufficient room for this maneuver. It would be useful also to be able to use common knife brackets with different width trays that vary in width by amounts not equal to the distance between pegboard holes (i.e., 1" centers).

Accordingly, there is a need in the art for an improved pegboard mounting for a tray or rack to permit adjustable and versatile positioning of the rack with respect to adjacent sheets of pegboard, pegboard standards and pegboard which is already partially loaded.

SUMMARY OF THE INVENTION

The present invention fulfills this need in the art by providing an apparatus for displaying products at retail on a pegboard having spaced holes including at least two pegboard connection elements each including prongs spaced apart by a distance equal to spacing between holes in the pegboard, at least two knife brackets, each engageable with a corresponding pegboard connection element in a laterally adjustable connection, and a tray supported on the knife brackets and having product pushers movably mounted therein. The pegboard connection elements may be mounted on the pegboard by insertion of their respective prongs through holes in the pegboard, the knife brackets may each be engaged with a corresponding connection element to extend from the pegboard, and the tray may be mounted on the knife brackets.

Each pegboard connection element may have upper and lower inward-facing grooves spaced apart a first distance, and the knife brackets may have upper and lower outwardly-facing flanges spaced apart slightly less than the first distance to permit lateral insertion of the flanges in the grooves to engage the knife brackets with the pegboard connection elements. Preferably, the knife bracket has a rearward-facing surface and the pegboard connection element has a forward-facing nub disposed to frictionally engage the rearward-facing surface when the flanges are laterally inserted in the grooves. The pegboard connection element may have a wedge-shaped back plate to orient the knife bracket upwardly with respect to the pegboard.

In a preferred embodiment the pegboard connection element is made of a higher strength material than the knife bracket.

The knife bracket may have an L-shape, a first leg of the L-shape including a plate engageable with the pegboard connection element and a second leg of the L-shape including a tray support perpendicular to the plate, the first leg having a recess located at a point of intersection with the tray support.

In one embodiment, at least one of a knife bracket or the tray includes a plurality of indentations along a direction extending from the pegboard and the other of the knife bracket or the tray has a catch shaped to be received in one of the indentations to permit the spacing of the tray from the pegboard to be adjusted to a desired distance. The catch may be resiliently mounted and the catch and the indentations may be cooperatively shaped to avoid ratcheting of the position of the tray with respect to the pegboard. Preferably, at least one of knife brackets includes the plurality of indentations and the tray has the catch.

The tray preferably includes front and rear walls. The front wall includes a rearward-extending, downward-facing ledge element, the rear wall includes a forward-extending, downward-facing ledge element and at least one of the ledge elements is resiliently mounted to its respective wall. The product pusher has forward and rearward facing protrusions, so that the pusher may be located in the tray by placing one of its protrusions under one ledge and the other protrusion under the other ledge, with the resilience of the resiliently mounted ledge urging the ledges to retain the protrusions.

The invention also provides a method of displaying products at retail on a pegboard having spaced holes including mounting two pegboard connection elements on a pegboard by insertion of prongs on the pegboard connection elements through holes in the pegboard, engaging two knife brackets with corresponding pegboard connection elements mounted on the pegboard, and supporting a tray on the engaged knife brackets. The method may include installing product pushers in the tray.

The engaging step may include laterally inserting flanges on the knife brackets in grooves on the pegboard connection element to engage the knife brackets with the pegboard connection elements. The engaging step may also include positioning a recess located at a point of intersection of two legs of the knife bracket at a protruding portion of a pegboard support.

The supporting step may include engaging a catch on at least one of a knife bracket or the tray with one of a plurality of indentations along a direction extending from the pegboard on the other of a knife bracket or the tray to space the tray a desired distance from the pegboard.

The installing step may include locating the pusher in the tray by placing protruding ends of the pusher under ledges on front and rear walls of the tray and resiliently holding the pusher in place.

BRIEF DESCRIPTION OF THE DRAWINGS

The invention will be better understood after a reading of the Detailed Description of the Preferred Embodiments and a review of the drawings in which.

DETAILED DESCRIPTION OF THE PREFERRED EMBODIMENTS

Figure 1:
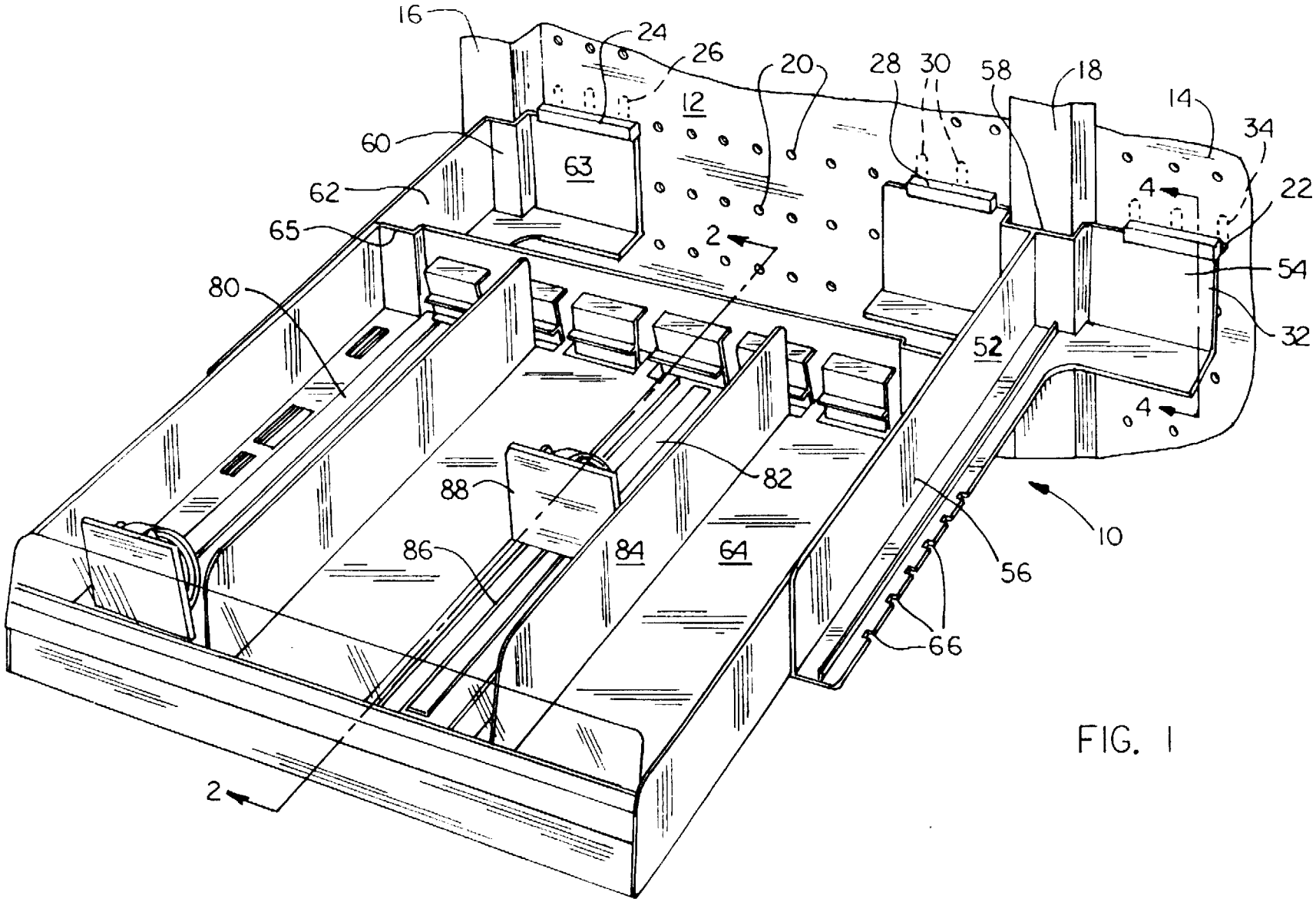
FIG. 1 is a perspective view of a preferred embodiment of the display rack, showing how it mounts on pegboard.

As seen in FIG. 1, the display apparatus 10 is provided available to be mounted on two adjacent sheets of pegboard 12,14. The pegboard sheets 12,14 are supported by vertical standards 16,18 which extend forwardly of the common plane of the pegboard sheets 12,14. Pegboard sheet 12 has a regular array 20 of holes, typically on one-inch centers. Similarly, pegboard 14 has an identical array of holes 22. However, the sheets 12,14 are not usually cut and mounted in standards 16,18 so that the regularity of the array 20 matches with the regularity of the array 22. Thus, for an apparatus like apparatus 10 to be mounted to span the two sheets 12,14, accommodation must be made for the lack of regularity between the holes 20 and holes 22.

As seen in FIG. 1, pegboard connection elements 24,28,32 are provided as members separable from the remainder of the apparatus 10. Connection element 24 has prongs 26 of a conventional design, arrayed in an array to match the array of holes 20, typically one inch on center. Similarly, elements 28,32 have respective prongs 30,34. The pegboard connection elements 24,28,32 are identical to one another.

Figure 4:
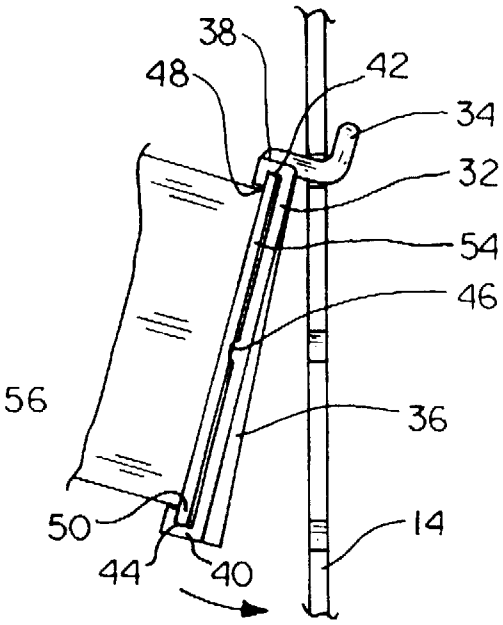
FIG. 4 is a is a sectional view of the embodiment of FIG. 1 taken along lines 4—4 looking in the direction of the arrows.

As seen in FIG. 4, a sectional view along lines 4—4 in FIG. 1, the connection element 32 is provided with a wedge-shaped base 36, which tends to cause the entire apparatus 10 to be directed at an acute angle to the upper part of the pegboard sheet 14, to compensate for possible sagging deflection in the pegboard sheet 14. The connection element 32 has upper and lower retaining ridges 38,40 forming inwardly facing grooves 42,44 and a nub 46 on the face of the element 32.

The grooves 42,44 receive respective flanges 48,50 of a plate 54 on a knife bracket 52. Thus, after mounting of the pegboard connection element on the pegboard, the plate 54 of the knife bracket may be laterally inserted into the pegboard connection element. The knife bracket is frictionally held in place by the frictional contact of the plate 54 with the nub 46. Alternatively, the nub 46 may be located on the plate 54 to engage a surface on the element 32. Preferably, the pegboard connection element is made of a high-strength plastic such as nylon or the like. The other components of the display rack can be made of a lower cost, lower strength plastic.

Referring back to FIG. 1, the knife bracket 62 is a single tray support knife bracket, unlike the knife bracket 52, which provides support for tray 64 as shown, as well as support for a tray to the right, not shown in FIG. 1. The knife brackets 52,62 have an L-shape. As seen with respect to knife brackets 52, the first leg 54 of the L-shape has its flanges 48,50 engageable with the pegboard connection element 38. The second leg 56 of the L-shape extends laterally from the pegboard 14 when mounted as described. At the intersection of the legs of the L-shapes 54,56, the plate of the knife bracket 52 is formed with a recess 58. Recess 58 permits the knife bracket to fit around a pegboard standard such as pegboard standards 16,18, although in the embodiment shown in FIG. 1, this is not needed since there is no standard at the location of recess 58. However, a similar recess 60 in the knife bracket 62 is shown permitting snug fitting against the standard 16. The knife brackets 52,62 are provided with a series of indexing indentations 66 for each tray. Bracket 56's indentations 66 used in connection with tray 64 are not shown in FIG. 1, being obscured by the presence of the tray 64.

Figure 3:
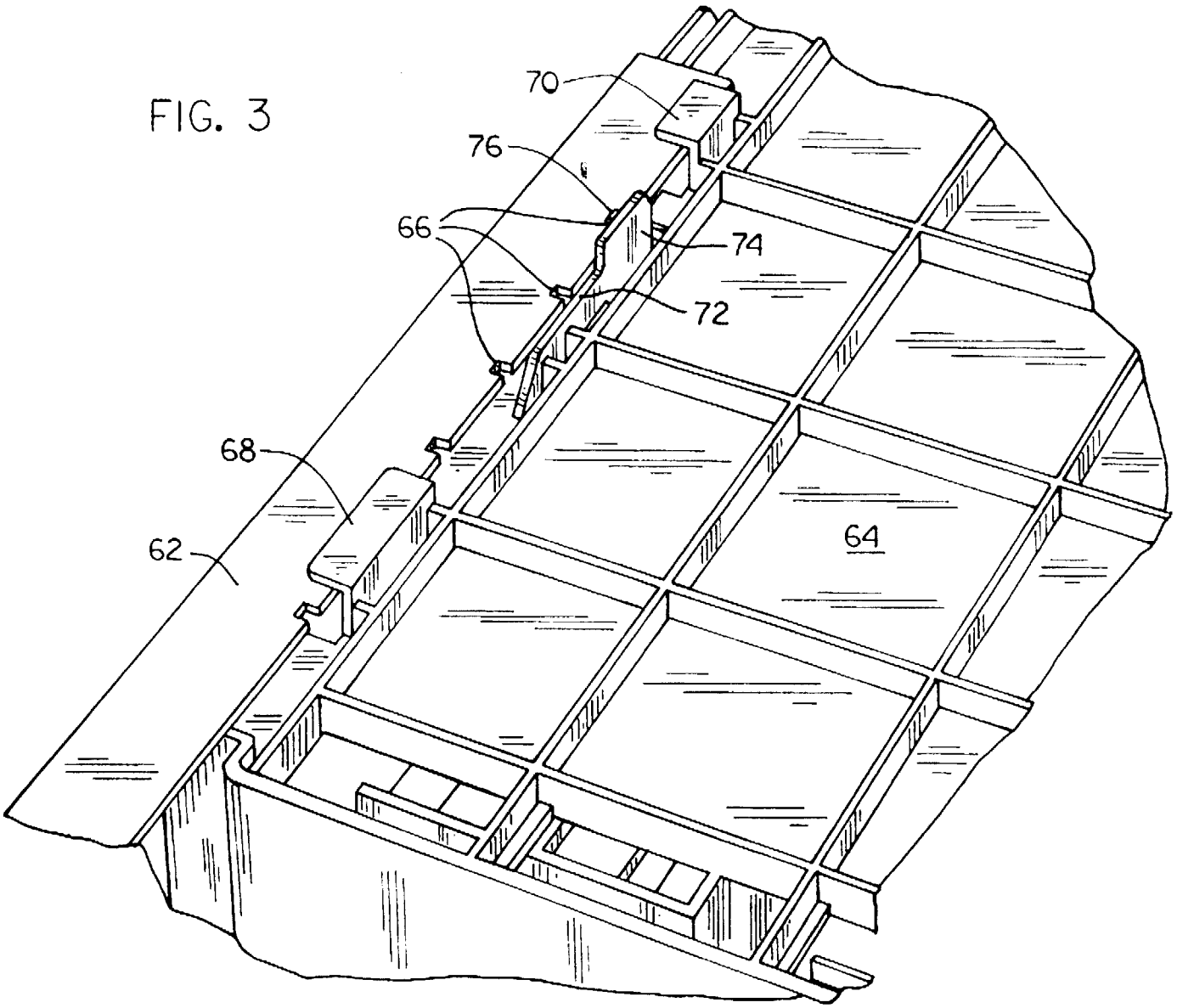
FIG. 3 is a perspective view of the bottom of the embodiment shown in FIG. 1.

The bottom of the tray 64 and the knife bracket 62 can be seen in FIG. 3. The tray 64 rides on the knife bracket 62 and has flanges 68,70 which extend under the bottom of the knife bracket 62 to prevent lifting of the tray off of the knife bracket. Molded as part of the tray 64 is a resilient tab 72 having a handle portion 74 and a catch 76. The catch 76 is preferably of a square-like configuration corresponding in shape and size to the indexing notches 66. The catch 76 and indentations 66 permit the position of the tray 64 with respect to the knife bracket 62 can be secured at a desired distance from the pegboard 12,14 to provide for the most effective presentation of the product to customers and a uniform projection toward the retail store aisle. Making the catch and indentations of the same size and square shape prevents ratcheting, which may be caused by accidental bumping of the tray 64. The handle portion 74 may be grasped from beneath the tray 64 to withdraw the catch 76 from an indexing indentation 66 to provide adjustment of the position or to remove the tray entirely, as desired by the merchandiser.

The tray 64 receives and supports a plurality of pusher track elements 80,82 as shown in FIG. 1. The pusher track elements are removable from the tray 64 for positioning as desired. Each pusher track element 80,82 has a side wall 84 and a product support track 86, as well as a pusher element of any suitable design. The pusher track 82 may be mounted in the tray 64 in any of an infinite number of locations left to right.

Figure 2:
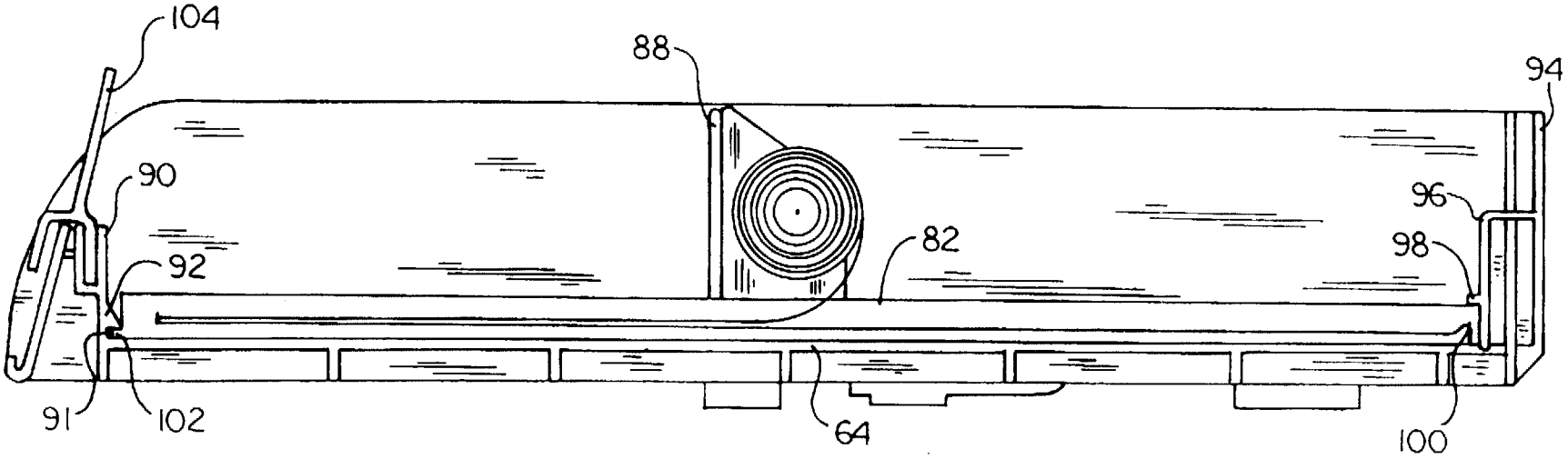
FIG. 2 is a sectional view of the embodiment of FIG. 1 taken along lines 2—2 looking in the direction of the arrows.

Referring now to FIG. 2, the tray 64 is shown having a front wall 90 having a ledge 92 and a frictional surface 91, such as may be provided by a strip of sandpaper or other friction-enhancing surface extending across the wall 90. The tray 64 also has a rear wall 94 and a resilient leaf spring 96 supporting a forward-facing ledge 98. The pusher track has a rear protrusion 100 and a forward protrusion 102, so that the protrusion 100 may be located under the ledge 98 of the rear wall 94. The forward ledge 92 is provided with a chamfered top surface and a protrusion 102 is provided with a chamfered lower surface so that the forward portion of the pusher track 82 may be simply pushed down to have the protrusion 102 pass the ledge 92 and snap into place, acting in opposition to the spring 96. The frictional surface 91 helps prevent sideways movement. The spring 96 will hold the pusher track in place between the ledges 92,98. The pusher 88 can then be retracted along the track 86 to allow the loading of product between the pusher 88 and the front wall 90.

A transparent product shield 104 is provided which holds product in place and also can receive indicia or labeling of the product mounted on the pusher track 86 therebehind.

In operation, the apparatus can be installed quite easily. First, the pegboard connection elements 26,30 are mounted to the pegboard at a distance apart suitable for receiving the tray 64 therebetween. However, it should be noted that the precise distance between the elements 28,30 is not important. Also, it should be noted that the pegboard elements 26,30 can be mounted even if there is an overlying shelf or other rack because their small size permits pivoting maneuvers even in a small space. Then, the knife brackets 52,62 are connected by laterally inserting their flanges 48,50 in the respective grooves 42,44 of the installed pegboard connection elements 28,30. The distance between the knife brackets can then be laterally adjusted so that the space between them is the precise amount appropriate to receive the tray 64. Then, the tray 64 is mounted to the knife brackets 52,62 by insertion from their ends, with the ledges 68,70 passing underneath the knife bracket supports. The pusher tracks are then installed in the tray 64 in a number and spacing as desired for the product or products to be displayed. Each pusher track is installed by inserting its rear protrusion 100 under the forward-facing ledge 98 on the rear wall of the tray, followed by forcing the front protrusion 102 downwardly past the rearwardly facing ledge 92 on the front wall of the tray. The rear wall 94 has a plurality of springs 96 with corresponding ledges 98, and it may very well be that any given installation of a pusher track 82 will span two of the spring elements 96. The product can then be loaded onto the pusher tracks. The distance of the tray 64 from the pegboard 12,14 may be adjusted as desired by retracting the catch 76 from an indentation 66 through the use of the handle 74 and moving the tray so the catch 76 engages a desired indentation 66. Preferably, the tray is provided with catches for each side, so that both are manipulated simultaneously to position the tray with respect to the two supporting knife brackets. If desired, the pusher tracks can be installed in the tray prior to its being mounted on the knife brackets.

Those of ordinary skill in the art will appreciate that various modifications can be made to the components described above, and all such modifications falling within the scope of the invention are deemed to be included within the scope of this patent.

What is claimed is:

1. An apparatus for displaying products on a pegboard having spaced holes comprising at least two pegboard connection elements each including prongs spaced apart by a distance equal to spacing between holes in the pegboard, at least two brackets, each engageable with a corresponding pegboard connection element in a laterally adjustable connection, and a tray supported on said brackets and having product pushers movably mounted therein, whereby said pegboard connection elements may be mounted on the pegboard by insertion of their respective prongs through holes in the pegboard, said brackets may each be engaged with a corresponding connection element to extend from the pegboard and said tray may be mounted on said brackets, wherein each pegboard connection element has upper and lower inward-facing grooves spaced apart a first distance, and said brackets have upper and lower outwardly-facing flanges spaced apart slightly less than the first distance to permit lateral insertion of said flanges in said grooves to engage said brackets with said pegboard connection elements.

2. An apparatus as claimed in claim 1 wherein said bracket is a knife bracket.

3. An apparatus as claimed in claim 1 wherein said bracket has a rearward-facing surface and said pegboard connection element has a forward-facing nub disposed to frictionally engage said rearward-facing surface when said flanges are laterally inserted in said grooves.

4. An apparatus for displaying products on a pegboard having spaced holes comprising at least two pegboard connection elements each including prongs spaced apart by a distance equal to spacing between holes in the pegboard, at least two brackets, each engageable with a corresponding pegboard connection element in a laterally adjustable connection, and a tray supported on said brackets and having product pushers movably mounted therein, whereby said pegboard connection elements may be mounted on the pegboard by insertion of their respective prongs through holes in the pegboard, said brackets may each be engaged with a corresponding connection element to extend from the pegboard and said tray may be mounted on said brackets, wherein said pegboard connection element has a wedge-shaped back plate to orient said bracket upwardly with respect to the pegboard.

5. An apparatus for displaying products on a pegboard having spaced holes comprising at least two pegboard connection elements each including prongs spaced apart by a distance equal to spacing between holes in the pegboard, at least two brackets, each engageable with a corresponding pegboard connection element in a laterally adjustable connection, and a tray supported on said brackets and having product pushers movably mounted therein, whereby said pegboard connection elements may be mounted on the pegboard by insertion of their respective prongs through holes in the pegboard, said brackets may each be engaged with a corresponding connection element to extend from the pegboard and said tray may be mounted on said brackets, wherein said pegboard connection element is made of a higher strength material than said bracket.

6. An apparatus for displaying products on a pegboard having spaced holes comprising at least two pegboard connection elements each including prongs spaced apart by a distance equal to spacing between holes in the pegboards, at least two brackets, each engageable with a corresponding pegboard connection element in a laterally adjustable connection, and a tray supported on said brackets and having product pushers movably mounted therein, whereby said pegboard connection elements may be mounted on the pegboard by insertion of their respective prongs through holes in the pegboard, said brackets may each be engaged with a corresponding connection element to extend from the pegboard and said tray may be mounted on said brackets, wherein said bracket includes an L-shape, a first leg of said L-shape including a plate engageable with said pegboard connection element and a second leg of said L-shape including a tray support perpendicular to said plate, said first leg having a recess located at a point of intersection with said tray support.

7. An apparatus for displaying products on a pegboard having spaced holes comprising at least two pegboard connection elements each including prongs spaced apart by a distance equal to spacing between holes in the pegboard, at least two brackets each engageable with a corresponding pegboard connection element in a laterally adjustable connection, and a tray supported on said brackets and having product pushers movably mounted therein, whereby said pegboard connection elements may be mounted on the pegboard by insertion of their respective prongs through holes in the pegboard, said brackets may each be engaged with a corresponding connection element to extend from the pegboard and said tray may be mounted on said brackets, wherein at least one of a bracket or said tray includes a plurality of indentations along a direction extending from the pegboard and the other of said bracket or said tray has a catch shaped to be received in one of said indentations to permit the spacing of the tray from the pegboard to be adjusted to a desired distance.

8. An apparatus as claimed in claim 7 wherein said catch is resiliently mounted and said catch and said indentations are cooperatively shaped to avoid ratcheting of the position of said tray with respect to the pegboard.

9. An apparatus for displaying products on a pegboard having spaced holes comprising at least two pegboard connection elements each including prongs spaced apart by a distance equal to spacing between holes in the pegboard, at least two brackets, each engageable with a corresponding pegboard connection element in a laterally adjustable connection, and a tray supported on said brackets and having product pushers movably mounted therein, whereby said pegboard connection elements may be mounted on the pegboard by insertion of their respective prongs through holes in the pegboard, said brackets may each be engaged with a corresponding connection element to extend from the pegboard and said tray may be mounted on said brackets, wherein at least one of said brackets includes a plurality of indentations along a direction extending from the pegboard and said tray has a catch shaped to be received in one of said indentations to permit the spacing of the tray from the pegboard to be adjusted to a desired distance.

10. An apparatus for displaying products on a pegboard having spaced holes comprising at least two pegboard connection elements each including prongs spaced apart by a distance equal to spacing between holes in the pegboard, at least two brackets, each engageable with a corresponding pegboard connection element in a laterally adjustable connection, and a tray supported on said brackets and having product pushers movably mounted therein, whereby said pegboard connection elements may be mounted on the pegboard by insertion of their respective prongs through holes in the pegboard, said brackets may each be engaged with a corresponding connection element to extend from the pegboard and said tray may be mounted on said brackets, wherein said a tray includes front and rear walls, said front wall includes a rearward-extending, downward-facing ledge element, said rear wall includes a forward-extending, downward-facing ledge element and at least one of said ledge elements is resiliently mounted to its respective wall, said product pusher having forward and rearward facing protrusions, whereby said pusher may be located in said tray by placing one of its protrusions under one ledge and the other protrusion under the other ledge, with the resilience of the resiliently mounted ledge urging the ledges into retaining relation to said protrusions.

11. An apparatus for displaying products on a pegboard having spaced holes comprising at least two pegboard connection elements each including prongs spaced apart by a distance equal to spacing between holes in the pegboard, at least two brackets, each engageable with a corresponding pegboard connection element in a laterally adjustable connection, and a product platform supported on said brackets for holding products to be displayed, whereby said pegboard connection elements may be mounted on the pegboard by insertion of their respective prongs through holes in the pegboard, said brackets may each be engaged with a corresponding connection element to extend from the pegboard, said product platform may be mounted on said brackets, and said products may be displayed on said product platform wherein said pegboard connection element is made of a higher strength material than said bracket.

12. An apparatus as claimed in claim 11 wherein said bracket is a knife bracket.

* * * * *